United States Patent [19]

Woodall, Jr. et al.

[11] 4,404,703

[45] Sep. 20, 1983

[54] PAINT ROLLER

[75] Inventors: Leigh C. Woodall, Jr., Roxboro; John T. Hayes, Durham; Robert G. Currier, Roxboro, all of N.C.

[73] Assignee: Collins & Aikman Corporation, New York, N.Y.

[21] Appl. No.: 373,710

[22] Filed: Apr. 30, 1982

[51] Int. Cl.[3] ..... B05C 17/02; B05D 5/02

[52] U.S. Cl. ..... 15/230.11; D4/38.1; 29/120; 427/260

[58] Field of Search ..... 15/230, 230.11, 209 R, 15/208; D4/38.1; 29/120; 427/260, 428; 428/36

[56] References Cited

U.S. PATENT DOCUMENTS 4,191,792 3/1980 Janssen ..... 15/230.11 X

*Primary Examiner*—Edward L. Roberts

*Attorney, Agent, or Firm*—Bell, Seltzer, Park & Gibson

[57] ABSTRACT

A paint roller particularly suited for texture painting and comprising a cylindrical core and a pile fabric covering secured to the cylindrical core, said pile fabric covering comprising a backing fabric and pile yarns interengaged with said backing fabric and extending from one face thereof to form a pile comprised of a multiplicity of upright pile loops, the density of the pile loops and the size of the pile yarns forming the loops being such as to render substantially the totality of each loop readily visible and to provide substantial void volume within the pile of the fabric for receiving and holding paint therein, said pile yarns each comprising a multifilament core and a polymeric coating forming a continuous sheath about the core and presenting the appearance of a monofilament pile yarn, said multifilament cores and sheath coatings cooperating to provide such flexural properties to the pile loops that the loops normally extend in a self-supporting, upright orientation from the backing fabric and are resiliently urged to such upright orientation upon the removal of pressure applied to the surface of the pile fabric, and wherein the flexural properties of the pile loops permit readily moving the pile loops from the upright orientation toward the flattened position upon pressure being applied to the pile surface during painting and thereby facilitating release of paint from within the pile.

18 Claims, 6 Drawing Figures

PAINT ROLLER

BACKGROUND OF THE INVENTION

This invention relates to a roller-type paint applicator and more particularly to a paint roller specifically designed for producing texture paint surfaces.

In the construction or remodeling of homes and other buildings, it is often desirable to provide walls or ceilings with a textured surface to mask or hide surface imperfections or cracks, or simply for the aeshetic effect that it provides. One popular way of obtaining such texture surfaces is with the use of texture paint, a thick viscous material which can be applied to the wall or ceiling surface in such a way that it is deposited unevenly and forms random peaks or other texture patterns. Texture paint surfaces have been produced heretofore by two primary methods: by applying the texture paint and thereafter contacting the surface before it dries with various implements designed to impart texture to the painted surface, or by applying the texture paint with a special texurizing roller which both applies the texture paint and forms the texture pattern in a single step. Prior texturizing rollers have been formed from various materials, including pile carpet, sculptured foam, and nonwoven web materials. The following prior patents are exemplary of prior art texturizing rollers:

| Patent No. | Issued | Inventor |
|---|---|---|
| 2,234,761 | March 11, 1941 | Harpootlian |
| 2,368,513 | January 30, 1945 | Adams |
| 2,428,953 | October 14, 1947 | Adams |
| 2,824,326 | February 25, 1958 | Ames |
| DES. 241,274 | August 31, 1976 | Hori |
| DES. 241,374 | September 7, 1976 | Hori |
| DES. 241,375 | September 7, 1976 | Hori |
| 3,955,260 | May 11, 1976 | Sherden |
| 4,191,792 | March 4, 1980 | Janssen |

The above prior art types of texturizing rollers generally suffer from one or more of the following disadvantages or limitations: exhibiting poor paint holding and release characteristics, difficulty and expense of manufacture, production quality problems, relatively high cost of raw materials adversely affected by certain paint solvents. With the foregoing in mind, it is an object of the present invention to provide an improved texturizing roller which eliminates or alleviates the above-noted problems of the prior art.

SUMMARY OF THE INVENTION

The paint roller of the present invention comprises a cylindrical core with a pile fabric covering secured to the core such that the roller has its outer surface formed from a multiplicity of upright open pile loops. The density of the pile loops and the size of the pile yarns forming the loops are such as to provide substantial void volume within the pile of the covering material for receiving and holding paint therein. This is evidenced by substantially the totality of each loop of the pile fabric covering material being readily visible, in contrast to the appearance of conventional types of pile fabrics, such as those used for floor coverings for example, where the pile loops are much more densly arranged.

The pile yarns forming the pile loops provide such flexural properties to the pile loops that the loops normally extend in a self-supporting, upright orientation and are resiliently urged to such upright orientation upon the removal of pressure being applied to the surface of the pile fabric. The flexural properties of the pile loops thus permit readily moving the pile loops from the upright orientation toward a flattened position upon pressure being applied to the pile surface during painting so as to thereby facilitate release of paint from within the pile.

The paint roller is further characterized by at least a majority of the upright open loops having the pile yarn thereof disposed in a nonplanar configuration so as to impart a random orientation and appearance to the pile. Further, the upright loops tend to twist upon themseelves to varying degrees, such that the bight portions of the loops at the outer surface of the fabric and which contact the painted surface are oriented essentially randomly so as to enhance the randomness of the texture surface imparted thereby.

In the embodiment illustrated and described more fully hereinafter, the pile fabric covering material is of a woven construction, although other fabric constructions may be employed in the paint roller. The upright, relatively sparsely distributed pile loops, and their random orientation with respect to one another are particularly advantageous in providing good paint holding and release characteristics and in imparting an essentially random nonrepetitive texture pattern to the painted surface.

BRIEF DESCRIPTION OF THE DRAWINGS

Some of the features and advantages of the invention having been stated, others will become apparent as the description proceeds, when taken in connection with the accompanying drawings, in which.

DESCRIPTION OF ILLUSTRATED EMBODIMENT

Figure 1:
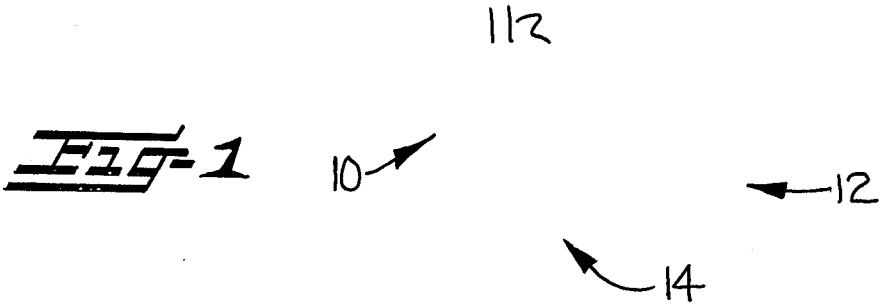
FIG. 1 is a perspective view showing the paint roller of the present invention.
Figure 2:
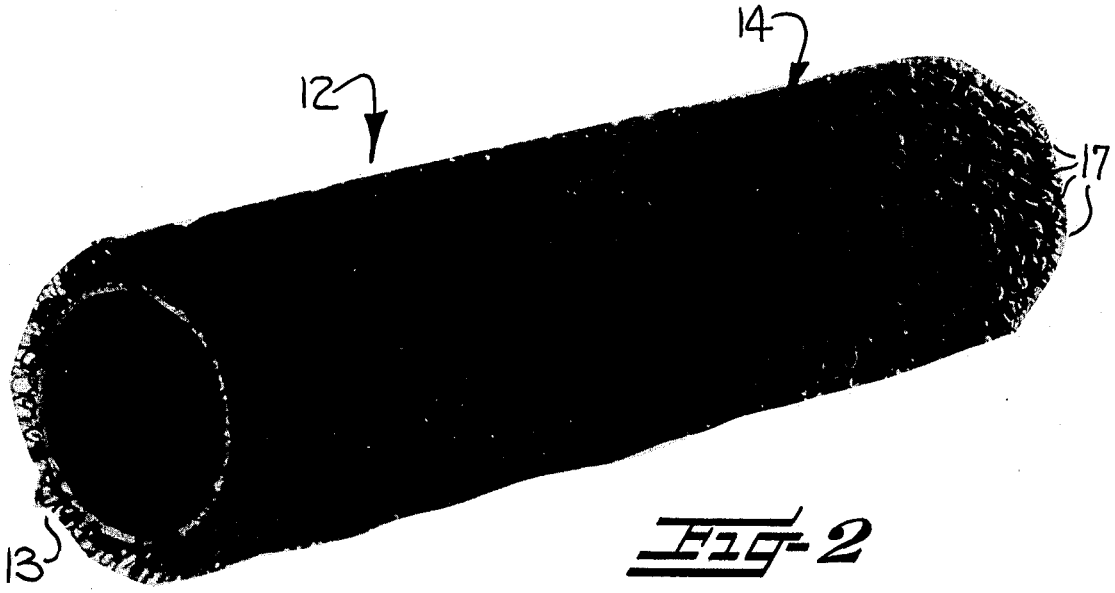
FIG. 2 is a photograph of the paint roller and particularly illustrating the random upright open loop pile.

Referring now in more detail to the drawings, the reference character 10 in FIG. 1 generally indicates a roller assembly including a conventional roller handle 11 carrying a paint roller 12 constructed in accordance with the present invention. The roller 12 includes a tubular cylindrical core, indicated at 13 in FIG. 2 and a pile fabric covering 14 adhesively secured to the exterior of the tubular core 13. The pile fabric 14 is in the form of a substantially uniform width strip and is spirally wrapped around the core 13 as indicated by the broken lines in FIG. 1 to form a substantially continuous uninterrupted pile texturing surface for the roller.

Figure 4:
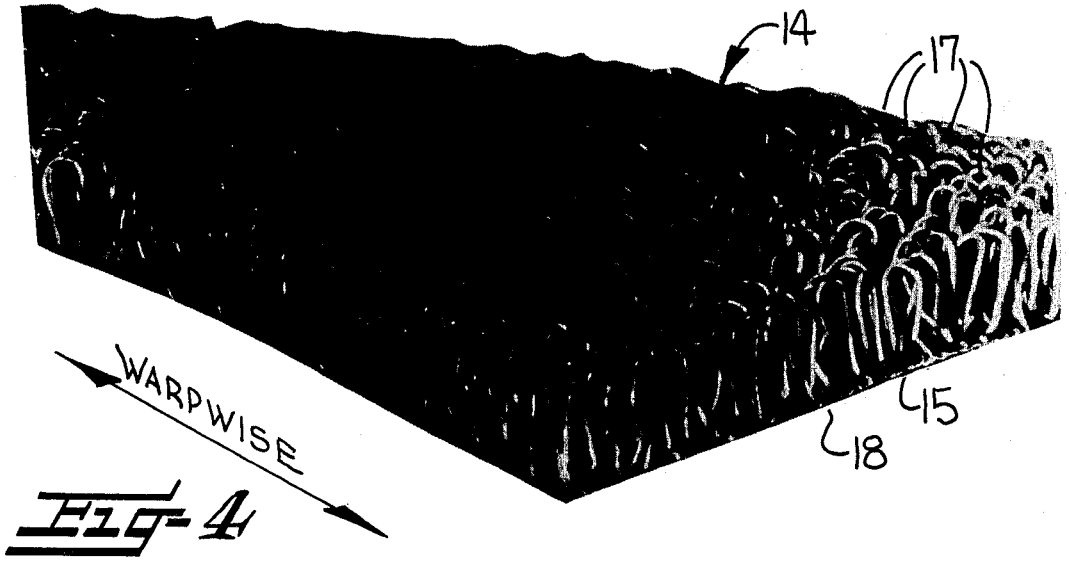
FIG. 4 is an enlarged top perspective view of the fabric.
Figure 5:
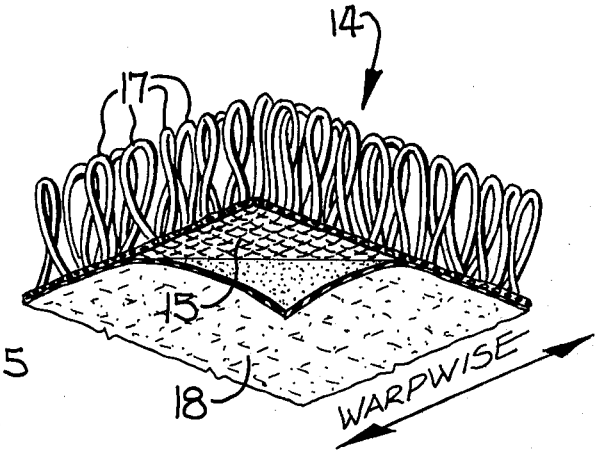
FIG. 5 is a diagrammatic perspective view showing the underside of the fabric.

The pile fabric 14 includes a backing fabric or base 15, best seen in FIGS. 4 and 5, and pile yarns P interengaged with the backing fabric and extending from one face of the backing fabric to form a multiplicity of upright open pile loops, indicated generally by reference character 17. The fabric also preferably includes a back coating 18 (FIG. 5) of latex or other suitable material, which assists in securing the pile loops 17 in place and also contributes to the dimensional stability of the fabric.

As noted above, the paint roller 12 is produced by spirally wrapping a strip of the pile fabric covering material 14 around the core 13. In order to produce a satisfactory product, it is important that the edges of the spirally wrapped strip of covering material be positioned in abutting relationship on the core to avoid gaps in the roller surface or overlapping of the spirally wrapped strip, either of which would produce an uneven surface on the paint roller and would cause streaks in the painted surface when the paint roller is used. The backing fabric 15 and optional back coating 18 serve to facilitate cutting of the pile covering material 14 into strips of uniform width and to provide dimensional stability to the strips to enable them to be wound onto the core without substantial stretching, and hence without variations in strip width which would lead to imperfections in the paint roller surface. The uniformity of strip width and dimensional stability of the covering material 14 used in this invention thus provide very significant manufacturing advantages over unbacked materials used in texturizing rollers of the prior art.

Figure 3:
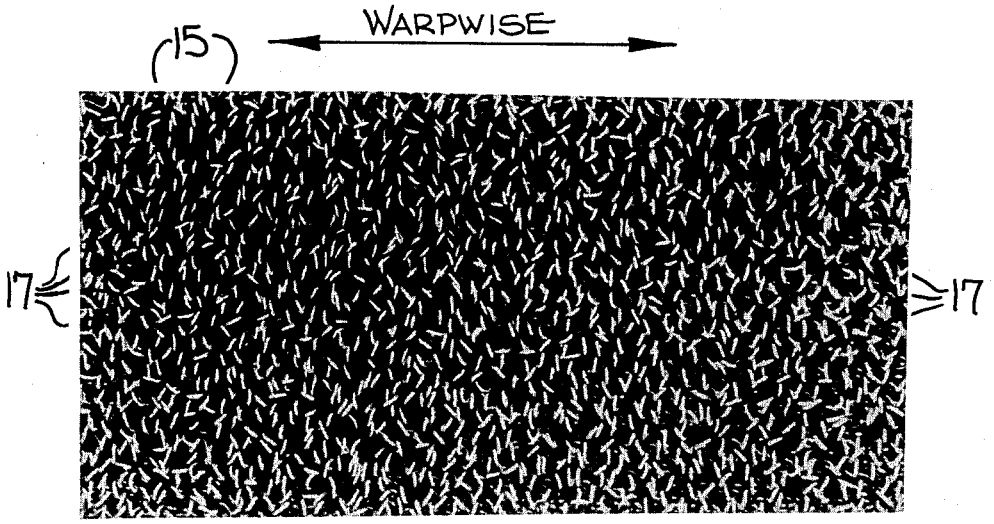
FIG. 3 is a photograph showing a top plan view of the pile fabric used in the paint roller.

Referring now more particularly to the pile covering fabric 14, it is preferred that the loops formed by the pile yarn P have a height above the backing fabric of at least about one-fourth inch, and most desirably that the pile height be within the range of about one-fourth to about one-half inch. As illustrated, the pile loops 17 extend in a self-supporting upright orientation from the backing fabric 15, without depending for support upon the adjacent surrounding pile loops. Moreover, the density of the pile loops, together with the size of the pile yarns, are such that substantially the entire loop is readily visible, and indeed, even the underlying backing fabric 15 is not obscured from view by the pile loops 17, as is readily evident from FIG. 3.

Preferably, the construction of the fabric is such that the pile loops are present at a density of from about 50 to about 150 pile loops per square inch. This relatively sparse density of the pile loops, and the relatively small diameter of the pile yarns in relation to the size of the loops, serve to provide a very substantial void volume within the pile of the fabric. This, together with the open nature of the loops, allows the fabric to receive and hold a significant amount of paint therein so that the painting can proceed relatively quickly and efficiently without the necessity for frequently stopping to reload the roller with paint.

It is preferred that the void volume of the fabric be at least 85 percent, and desirably higher. The percent void volume of the fabric may be defined as the percentage of the volume of the pile portion of the fabric which is not occupied by the pile yarns. This may be determined mathematically by calculating the total volume of a unit area of fabric and subtracting from that the volume of the backing fabric to thereby obtain the volume of the pile portion of the fabric. The volume occupied by the pile yarns may be calculated from the diameter of the pile yarn, the average length of pile yarn in each loop, and the number of pile loops per unit area. These calculations assume the fabric to be in a flat configuration. By way of example, for a woven pile fabric having the specifications listed below, the void volume was calculated to be 94 percent.

| | |
|---|---|
| Total thickness of fabric | .355 inch |
| Thickness of woven backing | .040 inch |
| Pile density | 97 loops/sq. in. |
| Pile yarn diameter | 18 mils |
| Average length of pile yarn in one pile loop | .730 inch |

In the preferred construction illustrated, it will be noted that the pile loops 17 defined by the pile yarns include leg portions 19 (FIG. 6) which extend from the backing fabric at spaced apart locations, forming the pile loops 17 therebetween. At the uppermost portion of the loop, the pile yarn P forms a generally U-shaped bight portion 20. The bight portions 20 of the respective loops are disposed a substantially uniform distance from the backing fabric such that the loops collectively form a substantially uniform height pile throughout the fabric. It will be evident from the accompanying figures, and in particular from the photographs of FIGS. 3 and 4 and the schematic illustration of FIG. 6, that the pile loops 17 are of a nonuniform shape and orientation so as to impart a substantially nondirectional grain to the pile, with the pile yarns forming some of the loops being twisted into a nonplanar configuration, and with other loops being of a nontwisted substantially U-shaped configuration. Moreover, the majority of the pile loops in the pile have a nonplanar, twisted configuration, and it will be seen that those loops that do twist tend to twist in the same direction. It will be further noted that while each loop extends substantially upright such that its bight portion 20 lies in a plane substantially perpendicular to the base fabric 15, the random orientation or twist to the respective loops causes the planes of at least a majority of the pile loop bight portions 20 to be nonaligned and nonparallel. This can be seen most clearly in FIG. 3, where the bight portions of the respective loops are most evident. It will thus be seen that the surface appearance presented by the bight portions of the pile loops is of a random, nonuniform nature. The result of these randomly oriented bight portions contacting a painted surface during the texture painting operation produces a random, nonrepetitive texture pattern in the painted surface.

The pile yarns P used in the pile fabric are selected for the flexural properties which they impart to the pile fabric. More specifically, the flexural properties of the pile yarns are such that the pile loops extend normally in a self-supporting upright orientation from the backing fabric 15. When pressure is applied to the surface of the pile fabric, the pile loops can be readily moved from the upright orientation toward a flattened position, thereby facilitating release of paint from within the pile. However, as soon as pressure is released, the pile loops resiliently return to an upright orientation.

Preferably, and as illustrated, the pile yarns are monofilaments. The monofilament pile yarns desirably have a diameter within the range from 9 mils to about 36 mils. An especially suitable type of monofilament pile yarn for use in the present invention, because of its strength and flexural properties, is a monofilament yarn of a sheath-core construction comprising a multifilament core and a polymeric coating forming a continuous sheath about the core. The core is preferably formed of continuous multifilament polyester, and the surrounding polymeric coating is of a material which is highly resistant to paint solvent, such as polyvinyl chloride for example.

In the preferred embodiment of the invention illustrated, the pile covering fabric 14 is of a woven construction, but those skilled in the art will recognize that many of the features and advantages of the illustrated embodiment can be realized from other pile fabric constructions having a backing fabric with pile yarns extending therefrom.

Figure 6:
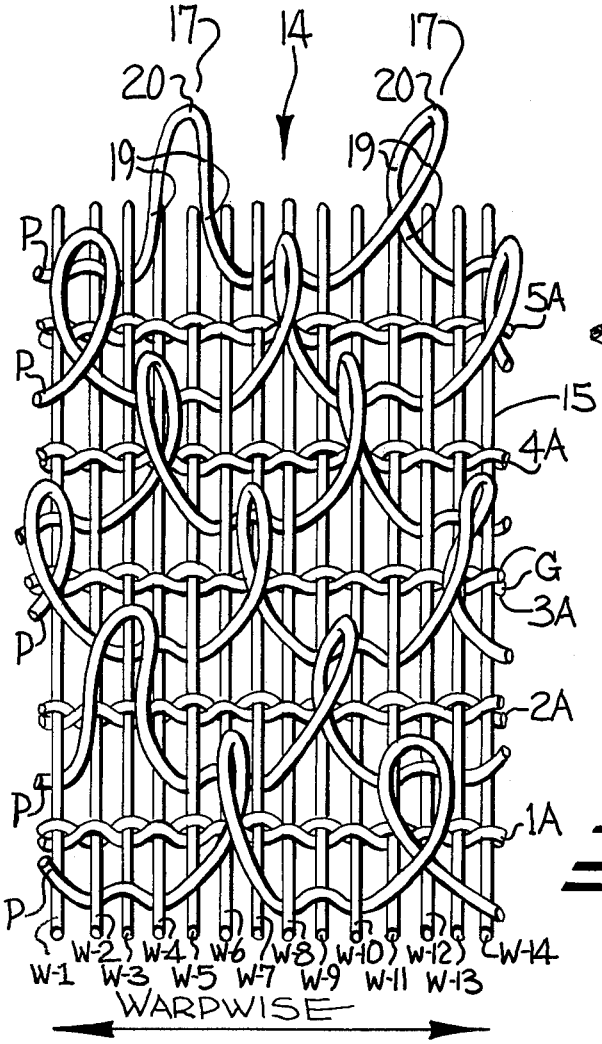
FIG. 6 is an enlarged schematic illustration of the weave structure of the fabric.
Figure 1:
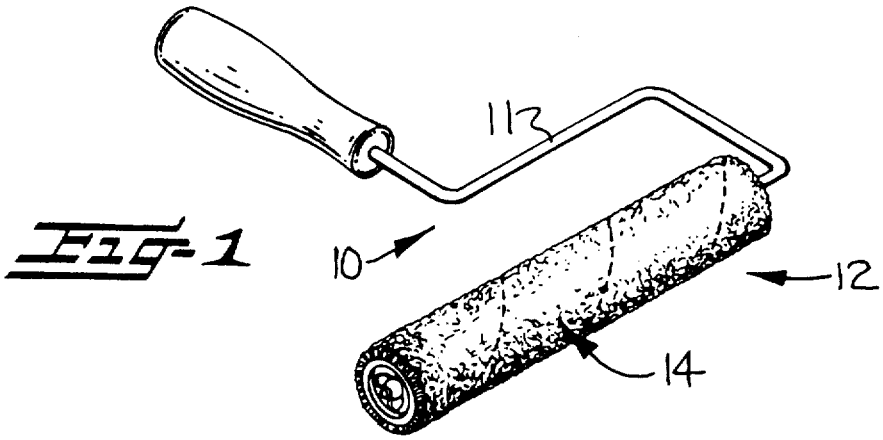
Figure 2:
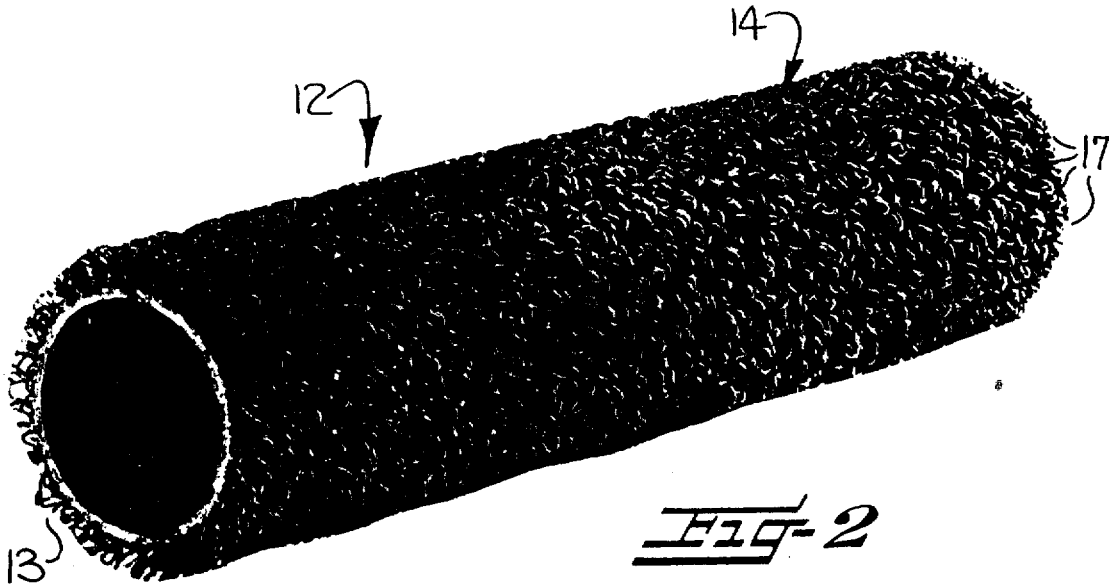
Figure 3:
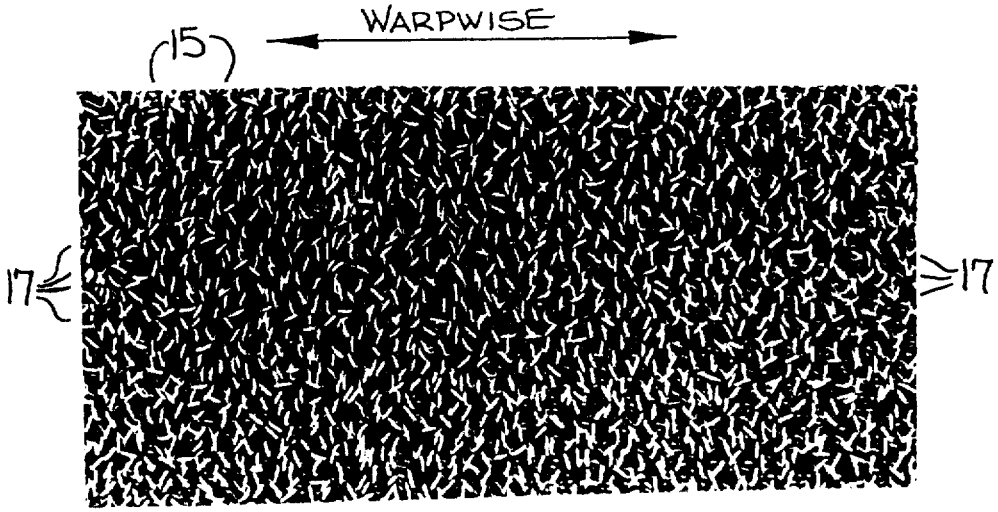

Referring more specifically to the weave construction of the fabric, it will be observed in FIG. 6 that the backing fabric or base 15 is woven from ground warp yarns G, in the form of chain warp yarns, interwoven with weft yarns W. The pile yarns P extend warpwise and are also interwoven with the weft yarns W and are so arranged as to extend from the backing fabric 15 at spaced locations in the formation of the pile loops 17 therefrom. As illustrated, six pick or weft yarns W are present in the formation of each successive pile loop 17 in each warpwise row of the pile loops. To insure that the pile yarns P are securely anchored to the backing fabric 15 between successive pile loops 17, it can be seen in FIG. 6 that there are three picks or weft yarns W between adjacent pile loops 17 in each warpwise row, with the pile yarn P in each warpwise row of pile loops 17 extending under the two weft yarns W nearest the leg portions 19 of two warpwise adjacent pile loops 17 and extending over the weft yarn located between the latter two weft yarns. Thus, the backing fabric 15 binds the pile yarns P between those two weft yarns so as to firmly anchor the legs 19 of the adjacent pile loops 17 in the backing fabric 15.

Preferably, in order to enhance the openness of the pile loops and provide substantial void volume in the pile, the leg portions 19 of each pile loop are spaced apart with several weft yarns W intervening. Thus, in the particular construction illustrated, it will be seen that each pile loop extends over and across three successive weft yarns W.

As illustrated in FIG. 6, the warpwise rows of pile loops are arranged in alternation with pairs of the ground warp yarns G, although a greater number of ground warp yarns may be provided between adjacent warpwise rows of pile loops, if desired. In order to enhance the random surface appearance to the pile fabric and avoid leaving gaps, the pile loops formed by adjacent pile yarns P, rather than being arranged in weftwise rows, are staggered throughout the fabric. In the particular weave construction illustrated, six warpwise rows of pile loops are required to complete a repetitive pattern weftwise of the fabric.

To further enhance the irregular relative disposition of the pile loops 17, it will be seen that in the preferred embodiment illustrated not only are the pile loops in the warpwise rows staggered or offset with respect to the pile loops in adjacent rows, but the extent to which the pile loops in some of the warpwise rows are offset relative to the pile loops in certain adjacent rows varies in some instances. As viewed in FIG. 6, for example, while six picks are involved in the formation of each successive pile loop 17, it can be seen that two adjacent pile loops in the first or lowermost row 1A of FIG. 6 are formed over the weft yarns W5, W6, W7, and W11, W12, W13, while adjacent pile loops 17 in the next warpwise row 2A are formed over weft yarns W2, W3, W4 and W8, W9, W10. Thus the loops in row 2A are staggered or offset from the loops 17 in row 1A by an odd number of weft yarns, namely three, which corresponds to one-half the number of weft yarns required to form a pile loop 17 in any given row. However, the pile loops 17 in the next adjacent warpwise row 3A are offset in the same direction from the loops of row 2A by an even number, i.e. only two weft yarns. The extent of offset between the pile loops 17 of row 4A relative to the loops of row 3A is the same as that between row 2A and 1A, namely three weft yarns.

In the drawings and specification, there has been set forth a preferred embodiment of the invention, and although specific terms are employed, they are used in a generic and descriptive sense only and not for purposes of limitation.

That which is claimed is:

1. A paint roller particularly suited for texture painting and comprising a cylindrical core and a pile fabric covering secured to the cylindrical core, said pile fabric covering comprising a backing fabric and pile yarns interengaged with said backing fabric and extending from one face thereof to form a pile comprised of a multiplicity of upright open pile loops, the density of the pile loops and the size of the pile yarns forming the loops being such as to render substantially the totality of each loop readily visible and to provide substantial void volume within the pile of the fabric for receiving and holding paint therein, said pile yarns having such flexural properties that the pile loops normally extend in a self-supporting, upright orientation from the backing fabric and are resiliently urged to such upright orientation upon the removal of pressure applied to the surface of the pile fabric, and wherein the flexural properties of the pile loops permit readily moving the pile loops from the upright orientation toward the flattened position upon pressure being applied to the pile surface during painting and thereby facilitating release of paint from within the pile.

2. A paint roller as set forth in claim 1 wherein a majority of the upright pile loops have the pile yarn thereof disposed in a nonplanar configuration imparting a random orientation and appearance to the pile.

3. A paint roller as set forth in claim 2 wherein said majority of the pile loops are disposed in a twisted configuration.

4. A paint roller as set forth in claim 1 wherein said pile loops are present at a density of from about 50 to about 150 pile loops per square inch.

5. A paint roller as set forth in claim 1 wherein the pile formed by said upright pile loops has a height of from about one-fourth to about one-half inch.

6. A paint roller as set forth in claim 1 wherein the pile yarn forming each upright pile loop extends from the backing fabric at spaced apart locations and forms therebetween a bight portion, the bight portions of the respective pile loops being located a uniform disance above the backing fabric and collectively defining the uppermost surface of the pile.

7. A paint roller as set forth in claim 1 wherein the pile yarn forming each pile loop comprises a multifilament core and a polymeric coating forming a continuous sheath and presenting the appearance of a monofilament pile yarn, said multifilament cores and sheath coatings cooperating to provide said flexural properties to the pile yarns.

8. A paint roller particularly suited for texture painting and comprising a cylindrical core and a pile fabric covering secured to the cylindrical core, said pile fabric covering comprising a backing fabric and pile yarns interengaged with said backing fabric and extending from one face thereof to form a pile comprised of a multiplicity of upright open pile loops, the pile loops being present at a density of from about 50 to about 150 loops per square inch and the size of the pile yarns forming the loops being such that each pile loop has the major portion thereof out of contact with the adjacent surrounding pile loops and substantially the totality of each loop is readily visible to provide substantial void volume within the pile of the fabric for receiving and holding paint therein, said pile yarns each comprising a multifilament core and a polymeric coating forming a continuous sheath about the core and presenting the appearance of a monofilament pile yarn, said multifilament cores and sheath coatings cooperating to provide such flexural properties to the pile loops that the open loops normally extend in a self-supporting, upright orientation from the backing fabric and are resiliently urged to such upright orientation upon the removal of pressure applied to the surface of the pile fabric, and wherein the flexural properties of the pile loops permit readily moving the pile loops from the upright orientation toward the flattened position upon pressure being applied to the pile surface during painting and thereby facilitating release of paint from within the pile.

9. A paint roller as set forth in claim 8 wherein each of the upright pile loops forms a bight portion lying in a plane substantially perpendicular to the base fabric, and wherein the bight portions of the respective pile loops are located a substantially uniform distance above the backing fabric to thereby define a substantially uniform height pile, and wherein the upright pile loops are randomly oriented with the planes of at least the majority of the pile loop bight portions being nonparallel.

10. A paint roller particularly suited for texture painting and comprising a cylindrical core and a woven pile fabric covering secured to the cylindrical core, said pile fabric covering comprising a woven backing faric formed of ground warp yarns interwoven with weft yarns, and pile yarns interwoven with said backing fabric and extending from one face thereof to form a multiplicity of upright open pile loops, the density of the pile loops and the size of the pile yarns forming the loops being such as to render substantially the totality of each loop readily visible and to provide substantial void volume within the pile of the fabric for receiving and holding paint therein, said pile yarns having such flexural properties that the loops normally extend in a self-supporting, upright orientation from the backing fabric and are resiliently urged to such upright orientation upon the removal of pressure applied to the surface of the pile fabric, and wherein the flexural properties of the pile loops permit readily moving the pile loops from the upright orientation toward the flattened position upon pressure being applied to the pile surface during painting and thereby facilitating release of paint from within the pile.

11. A paint roller as set forth in claim 10 wherein a plurality of weft yarns are interwoven with the pile yarns between each of the pile loops so as to firmly anchor the respective pile loops to the backing fabric.

12. A paint roller as set forth in claim 10 wherein each of the pile yarns extends warpwise and forms warpwise rows of pile loops.

13. A paint roller as set forth in claim 12 wherein the pile loops in each warpwise row are offset from the pile loops in adjacent rows.

14. A paint roller as set forth in claim 12 wherein each of the warpwise-extending pile yarns is interwoven with at least three adjacent weft yarns of the backing fabric on each side of each loop so as to firmly anchor the respective pile loops to the backing fabric.

15. A paint roller as set forth in claim 12 wherein each of the pile loops extends over and across a plurality of successive weft yarns imparting an open configuration to each pile loop.

16. A paint roller particularly suited for texture painting and comprising a cylindrical core and a woven pile fabric covering secured to the cylindrical core, said pile fabric covering comprising a woven backing fabric formed of ground warp yarns interwoven with weft yarns, and warpwise extending pile yarns arranged between certain adjacent ground warp yarns and being interwoven with said weft yarns and extending from the backing fabric to form warpwise rows of upright open pile loops, the pile loops being present at a density of from about 50 to 150 loops per square inch and the size of the pile yarns forming the loops being such that each pile loop has the major portion thereof out of contact with the adjacent surrounding pile loops and substantially the totality of each loop is readily visible to provide substantial void volume within the pile of the fabric for receiving and holding paint therein, said pile yarns having such flexural properties that the loops normally extend in a self-supporting, upright orientation from the backing fabric and are resiliently urged to such upright orientation upon the removal of pressure applied to the surface of the pile fabric, and wherein the flexural properties of the pile loops permit readily moving the pile loops from the upright orientation toward the flattened position upon pressure being applied to the pile surface during painting and thereby facilitating release of paint from within the pile.

17. A paint roller as set forth in any one of claim 1, 10 or 16 wherein each of said pile yarns has a diameter of from 9 to 36 mils.

18. A paint roller as set forth in claim 10 or 16 wherein each of said pile yarns comprises a multifilament core and a polymeric coating forming a continuous sheath about the core and presenting the appearance of a monofilament pile yarn.

* * * * *

UNITED STATES PATENT AND TRADEMARK OFFICE

CERTIFICATE OF CORRECTION

PATENT NO. : 4,404,703

DATED : September 20, 1983

INVENTOR(S) : Leigh C. Woodall, Jr., et al

It is certified that error appears in the above-identified patent and that said Letters Patent is hereby corrected as shown below:

Column 1, line 8, "aeshetic" should be --aesthetic--;
Column 2, line 15, "seelves" should be --selves--;
(Claim 6) Column 6, line 52, "disance" should be --distance--;
(Claim 10) Column 7, line 36, "faric" should be --fabric--;
Sheet 1 of 2 of the drawings should be deleted to appear as per attached sheet 1 of 2.

Signed and Sealed this

*Third* Day of *April 1984*

[SEAL]

*Attest:*

*Attesting Officer*

GERALD J. MOSSINGHOFF

*Commissioner of Patents and Trademarks*